United States Patent [19]

Ridley

[11] 4,167,291

[45] Sep. 11, 1979

[54] METHOD OF FORMING AN IN SITU OIL SHALE RETORT WITH VOID VOLUME AS FUNCTION OF KEROGEN CONTENT OF FORMATION WITHIN RETORT SITE

[75] Inventor: Richard D. Ridley, Bakersfield, Calif.

[73] Assignee: Occidental Oil Shale, Inc., Grand Junction, Colo.

[21] Appl. No.: 865,704

[22] Filed: Dec. 29, 1977

[51] Int. Cl.[2] ..... E21B 41/10

[52] U.S. Cl. ..... 299/2

[58] Field of Search ..... 299/2, 13; 166/259

[56] References Cited

U.S. PATENT DOCUMENTS

| | | | |
|---|---|---|---|
| 3,980,339 | 9/1976 | Heald et al. | 299/2 |
| 4,017,119 | 4/1977 | Lewis | 299/2 |
| 4,043,598 | 8/1977 | French et al. | 299/2 |

*Primary Examiner*—Ernest R. Purser
*Attorney, Agent, or Firm*—Christie, Parker & Hale

[57] ABSTRACT

An in situ oil shale retort is formed in a subterranean formation containing oil shale. The formation comprises at least one stratum of relatively higher average kerogen content which is included in formation of relatively lower average kerogen content. A void is excavated in a retort site in the formation, leaving a remaining portion of unfragmented formation within the retort site adjacent the void. The portion of unfragmented formation within the retort site is explosively expanded toward the void to form a fragmented permeable mass of formation particles containing oil shale in an in situ retort in which fragmented formation particles from the stratum of higher kerogen content have a larger void fraction than the averge void fraction of the fragmented mass. This can be accomplished by enlarging the void in the vicinity of the stratum having the higher kerogen content prior to explosive expansion. When the fragmented mass is retorted, there is no substantial increase in resistance to flow of gas through the fragmented mass due to the relatively higher thermal expansion of fragmented formation particles having the higher kerogen content.

13 Claims, 7 Drawing Figures

METHOD OF FORMING AN IN SITU OIL SHALE RETORT WITH VOID VOLUME AS FUNCTION OF KEROGEN CONTENT OF FORMATION WITHIN RETORT SITE

CROSS REFERENCE TO RELATED APPLICATION

This application is related to copending application Ser. No. 864,716, entitled IN SITU OIL SHALE RETORT WITH VARIATIONS IN SURFACE AREA CORRESPONDING TO KEROGEN CONTENT OF FORMATION WITHIN RETORT SITE, filed Dec. 27, 1977, by Chang Yul Cha and assigned to the assignee of this application. The subject matter of that application is incorporated herein by this reference.

BACKGROUND

This application relates to in situ recovery of shale oil, and more particularly, to techniques for minimizing any effect on gas flow resistance in an in situ retort caused by a tendency of higher grade oil shale to expand upon heating more than does lower grade shale.

The term "oil shale" as used in the industry is in fact a misnomer; it is neither shale, nor does it contain oil. It is a sedimentary formation comprising marlstone deposit with layers containing an organic polymer called "kerogen" which, upon heating, decomposes to produce hydrocarbon liquid and gaseous products. The formation containing kerogen is called "oil shale" herein and the hydrocarbon liquid product is called "shale oil."

One method for recovering shale oil is to form an in situ retort in a subterranean formation containing oil shale. Oil shale formation within an in situ retort site is fragmented to form a retort containing a fragmented permeable mass of formation particles containing oil shale. Formation particles at the top of the fragmented mass are ignited to form a combustion zone, and an oxygen-supplying gas, such as air, is supplied to the top of the fragmented mass for sustaining the combustion zone and for advancing the combustion zone downwardly through the fragmented mass. As the combustion zone advances through the fragmented mass, hot processing gas forms a retorting zone on the advancing side of the combustion zone. In the retorting zone, kerogen in the formation particles is decomposed to produce shale oil and gaseous products. Thus, a retorting zone moves from top to bottom of the fragmented mass in advance of the combustion zone. The shale oil and gaseous products produced in the retorting zone pass to the bottom of the fragmented mass for collection.

U.S. Pat. No. 4,043,595, which is assigned to the same assignee as this application, discloses a method for explosively expanding formation containing oil shale to form an in situ oil shale retort. That patent is incorporated herein by this reference. According to a method disclosed in that patent, an in situ retort is formed by excavating formation to form a columnar void bounded by unfragmented formation having a vertically extending free face, drilling blasting holes adjacent the columnar void and parallel to the free face, loading the blasting holes with explosive, and detonating the explosive. This expands the formation adjacent the columnar void toward the free face in layers severed in a sequence progressing away from the free face so that fragmented formation particles occupy the columnar void and the space in the in situ retort site originally occupied by the expanded shale prior to such explosive expansion. The void fraction or void volume in the fragmented mass corresponds to the volume of the columnar void formed before explosive expansion. The void fraction in the resulting fragmented mass is determined by the volume of formation removed from the retort site to form a void space toward which unfragmented formation remaining in the retort site is explosively expanded, inasmuch as such unfragmented formation is fragmented and expanded to fill such a void space. The original void volume is essentially distributed between the fragmented formation particles in the retort being formed.

Oil shale deposits occur in generally horizontal beds, and within a given bed there are an extremely large number of generally horizontal deposition layers containing kerogen known as "varves." The kerogen content of the formation is typically nonuniformly dispersed throughout a given bed.

The average kerogen content of formation containing oil shale can be determined by a standard "Fischer assay" in which a core sample customarily weighing 100 grams and representing one foot of core is subjected to controlled laboratory analysis involving grinding the sample into small particles which are placed in a sealed vessel and subjected to heat at a known rate of temperature rise to measure the kerogen content of the core sample. Kerogen content is usually stated in units of "gallons per ton," referring to the number of gallons of shale oil recoverable from a ton of oil shale heated in the same manner as in the Fischer analysis.

The average kerogen content of formtion containing oil shale varies over a broad range from essentially barren shale having no kerogen content up to a kerogen content of about 70 gallons per ton. Localized regions can have even higher kerogen contents, but these are not common. It is often considered uneconomical to retort formation containing oil shale having an average kerogen content of less than about 8 to 10 gallons per ton.

Formation containing oil shale is suitable for in situ retorting can be hundreds of feet thick. Often there are strata of substantial thickness within such formation having significantly different kerogen contents than other strata in the same formation. Thus, for example, in one formation containing oil shale in Colorado that is a few hundred feet thick, the average kerogen content is in the order of about 17 gallons per ton. Within this formation there are strata 10 feet or so thick in which the kerogen content is in excess of 30 gallons per ton. In another portion of the same formation there is a stratum almost 30 feet thick having nearly zero kerogen content. Similar stratification of kerogen content occurs in many formations containing oil shale.

As described above, during the course of retorting, hot retorting gas flows downwardly through the fragmented mass of formation particles in an in situ retort. The void fraction of the fragmented mass influences the resistance of the fragmented mass to such gas flow. A fragmented mass with a high void volume has low resistance to gas flow, while a fragmented mass with low void volume has a high resistance to gas flow. Flow resistance of the fragmented mass is important inasmuch as retorting may be continued for an extensive period of time. For example, one experimental in situ retort a little over 80 feet high was retorted over a period of 120 days. If there is a high resistance to gas flow, a relatively high pressure drop will occur along the length of the fragmented mass. As a result, the blowers or compressors used for inducing gas flow will operate at relatively high pressure (for example, 5 psig) which requires appreciably more energy for driving the compressor or blower than if the pressure drop is relatively low. The total energy requirements can be relatively high because of the long time required for retorting. Higher pressure operation also can take a greater capital expenditure for blowers or compressors, and some gas leakage from the retort can occur, further reducing efficiency.

It is also desirable in forming an in situ retort to keep the total void volume as low as possible because of the cost of mining to form a void into which formation containing oil shale is expanded. Further, when the void is formed in the retort site, removed formation either must be retorted by more cumbersome and polluting above-ground techniques, or the shale oil is lost when the mined out material is discarded.

Thus, the operator of an in situ oil shale retort is faced with opposing economic considerations that should be optimized. On one side is the cost and loss of total yield of the retort by mining out formation to create the void volume for the fragmented mass. On the other side is the cost of energy and equipment for forcing the retorting gas through the fragmented mass.

SUMMARY OF THE INVENTION

An in situ oil shale retort is formed in a retort site in a subterranean formation containing oil shale and having a stratum of formation having a higher kerogen content than the average kerogen content of formation within the retort site. Such a retort contains a fragmented permeable mass of formation particles containing oil shale in which fragmented formation particles from the stratum of higher kerogen content are explosively expanded more than the average explosive expansion of fragmented formation particles throughout the fragmented mass. That is, fragmented formation particles from the stratum of higher kerogen content have a higher void fraction than the average void fraction in the entire fragmented mass. During retorting there is an inherent increased thermal expansion of the fragmented particles having the higher kerogen content when such formation particles are heated. This is accommodated by the higher void fraction, thereby minimizing any effect on gas flow resistance through the fragmented mass.

In one form of the invention in which the stratum of higher kerogen content extends approximately horizontally through the retort site, a generally vertically extending void is excavated through the stratum of higher kerogen content. The void is enlarged in the vicinity of the stratum of higher kerogen content so the horizontal cross-section of the enlarged portion of the void is greater than the average horizontal cross-section of the remaining portion of the vertical void. Formation remaining within the retort site is explosively expanded toward the void to form a fragmented mass having a higher void fraction in the vicinity of the stratum of higher kerogen content than the average void fraction throughout the fragmented mass.

DRAWINGS

Features of specific embodiments of the best mode contemplated for carrying out the invention are illustrated in the drawings, in which.

DETAILED DESCRIPTION

Figure 1:
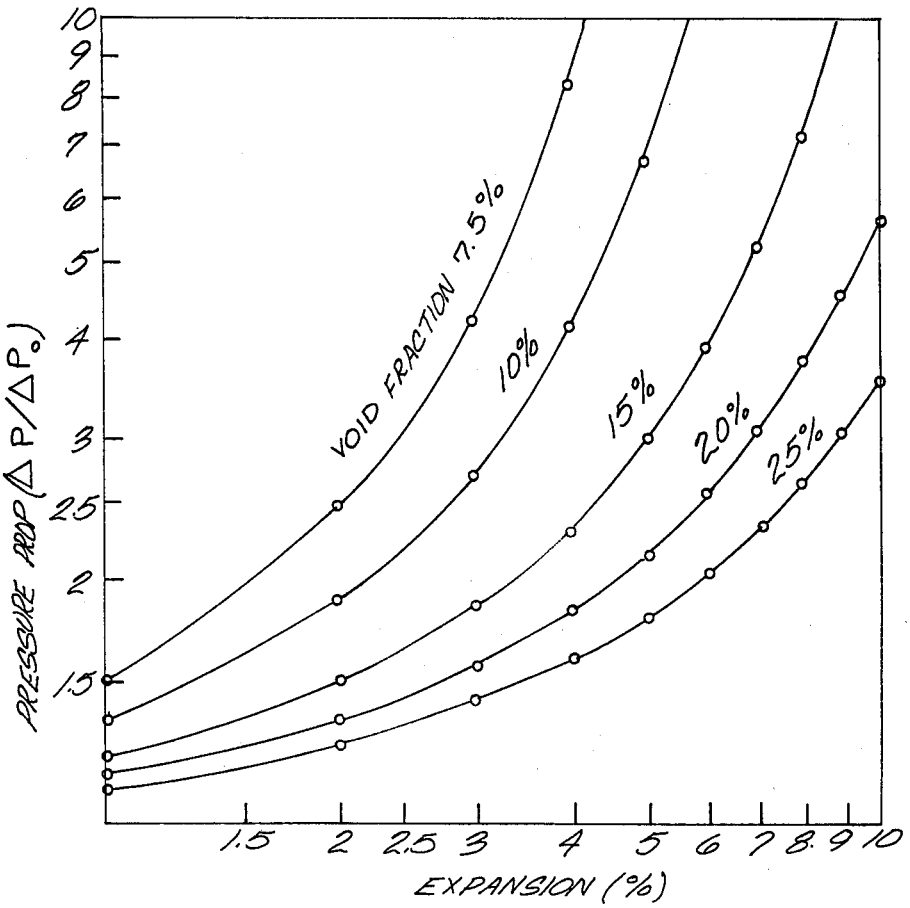
FIG. 1 is a graph indicating increase in pressure drop in an in situ oil shale retort as a function of the percentage expansion of fragmented formation particles containing oil shale for several void fractions.

FIG. 1 is a graph with a family of curves illustrating the pressure drop in a fragmented permeable mass of formation particles containing oil shale in an in situ oil shale retort for a variety of void fractions as a function of the expansion of such fragmented formation particles. Each curve illustrates the resistance to gas flow during retorting operations in a fragmented mass having such a void fraction. The graph is a log-log plot with thermal expansion in units of percent on the abcissa. The ordinate provides an indication of the pressure drop in terms of the ratio $\Delta P/\Delta P_o$, of a particular pressure drop, $\Delta P$, over the pressure drop without any expansion, $\Delta P_o$. Thus, the ratio would have a value of one if no thermal expansion occurred in the fragmented mass. The illustrated graph covers the range of the ratio for expansions between one and ten percent. A family of curves are plotted in FIG. 1 for fragmented mass in which the void fraction is 7.5%, 10%, 15%, 20% and 25% of the total volume in the fragmented mass.

As used herein void fraction is the ratio of the volume of the voids or spaces between particles in the fragmented mass to the total volume of the fragmented permeable mass of particles in an in situ oil shale retort. Thus, for example, for a void fraction of 15%, a volume defined by the by the boundaries of the retort site would be 85% occupied by fragmented formation particles containing oil shale, and 15% of the volume would be occupied by void spaces between the fragmented particles.

The pressure drop in an in situ oil shale retort is proportional to $$\frac{\alpha}{d_v^2} \cdot \frac{(1-\epsilon)^2}{\epsilon^3} u + \frac{\beta}{d_v} \cdot \frac{1-\epsilon}{\epsilon^3} u^2$$

where $\alpha$ and $\beta$ are constants of proportionality, $\epsilon$ is the void fraction, u is the velocity of gas through the fragmented mass, and $d_v$ indicates a mean particle size. The particle size $d_v$ is the ratio of particle volume to surface area and may include a shape factor. The absolute values of the various quantities are of minor significance for purposes of exposition, and it is only the proportionality that is of interest. At elevated temperature the void fraction $\epsilon=\epsilon_o-\gamma(1-\gamma)$, where $\gamma$ is the coefficient of thermal expansion, and $\epsilon_o$ is the void fraction without any thermal expansion of the particles containing oil shale.

Although exact figures are not readily available and different formations containing oil shale have somewhat different properties, it is found that the coefficient of expansion is a function of the kerogen content of the formation. There is a significantly larger coefficient of expansion in relatively rich formation having a relatively high kerogen content as compared with the coefficient of expansion in relatively lean formation having a relatively lower kerogen content. Formation having a rich kerogen content thus has a larger influence on pressure drop than does formation having a lean kerogen content. Formation particles containing the richer kerogen content expand more upon heating, thereby reducing the void fraction. This has been shown in an actual in situ oil shale retort.

It is believed that the large expansion of formation particles having a rich kerogen content can be in part due to thermal decomposition and resultant phase changes in the kerogen locked in the formation. Fragmented formation particles containing oil shale are relatively impervious, and thermal decomposition of the kerogen produces liquid and gaseous hydrocarbons at a rapid rate. Appreciable portions of the liquid hydrocarbons can be vaporized as retorting temperatures approach 900 degrees F. These products inherently occupy a higher volume than the kerogen from which they are formed. Because of limited diffusion rates some of these products can be temporarily isolated in the formation particles in which the kerogen is dispersed, and their increased volume places a stress on the formation particles that results in expansion appreciably larger than present in formation particles without such retorting products.

The permeability of a fragmented permeable mass of particles containing oil shale tends to decrease, and thus pressure drop across the fragmented mass tends to increase, as grade of oil shale being retorted increases. Fragmented formation particles containing higher grade oil shale tend to have a higher temperature during retorting than lower grade shale. In the retorting and combustion zones, volatilized hydrocarbons are released by decomposition of kerogen in the oil shale and carbon dioxide is released due to decomposition of alkaline earth metal carbonates, such as calcium and magnesium carbonates, present in oil shale. These thermally induced reactions increase the mass flow rate of gases on the advancing side of and in the retorting and combustion zones. This tends to increase the volumetric flow rate of the gases on the advancing side of and in the retorting and combustion zones, which tends to increase the pressure gradient across the retorting and combustion zones. In addition, the volume and viscosity of gases increase as their temperature increases, and therefore the pressure drop is increased across the relatively hotter zone of higher grade shale.

FIG. 1 is derived from the above equations and indicates the sensitivity of pressure drop increases to void fraction in the presence of appreciable expansion of fragmented formation particles containing oil shale. Thus, for example, when the void fraction of the fragmented mass is about 25%, a thermal expansion of the formation particles of 4% causes an increase in pressure drop to about 1.5 times the pressure drop without expansion. When the void fraction is 20%, the pressure drop increases to about 1.7 times the pressure drop in the absence of expansion. If the fragmented mass has a void fraction as low as 10%, the pressure drop increases to 4.1 times the original pressure drop when the expansion is only 4%. These increases in pressure drop translate into higher energy costs for the blowers used in retorting the fragmented mass.

Generally, it has been found desirable to have an average void volume or void fraction in a fragmented mass in the order of about 15% to 25% of the total volume. This appears to provide a good balance between the costs due to mining and the costs due to pressure drop in most in situ oil shale retorts. It is found, however, that as retorting progresses, there is an increase in the resistance to gas flow and hence an increase in pressure drop, Much of the increase is a temporary effect due to heating of the fragmented formation particles, and some appears to be a permanent effect due to particle degradation. The proportionate increase in gas flow resistance is not an important factor when the average void volume of the fragmented mass is relatively high, that is, for example, in excess of about 25%. When the average void volume is as low as 15%, or less, the increase in flow resistance during retorting can have a substantial effect.

Figure 2:
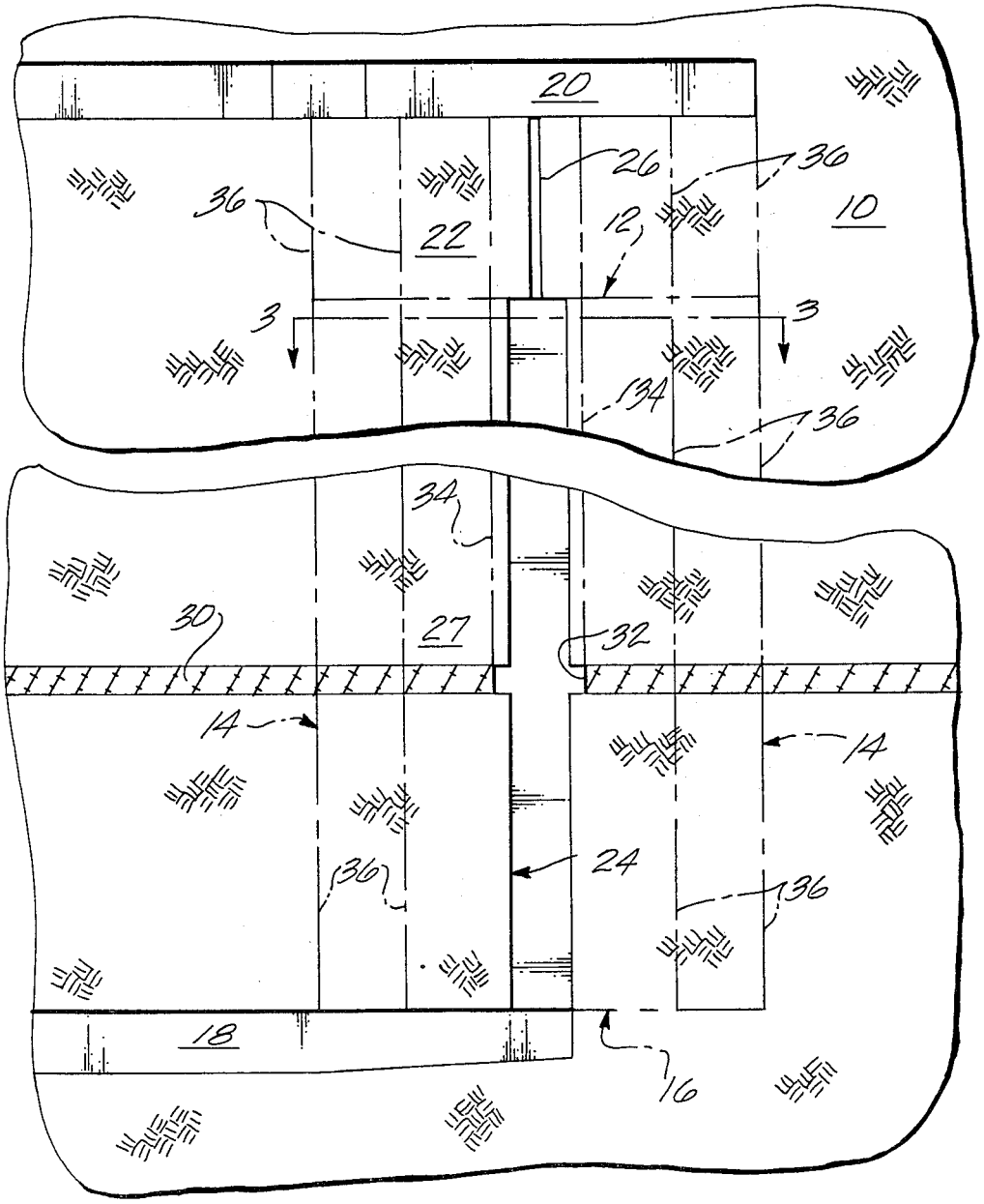
FIG. 2 is a semi-schematic cross-sectional side view taken on line 2—2 of FIG. 3 and showing a subterranean formation containing oil shale in which a columnar void is excavated within a retort site and a portion of the void is enlarged in proximity to a stratum of formation having a higher average kerogen content than the average kerogen content of formation within the retort site.
Figure 3:
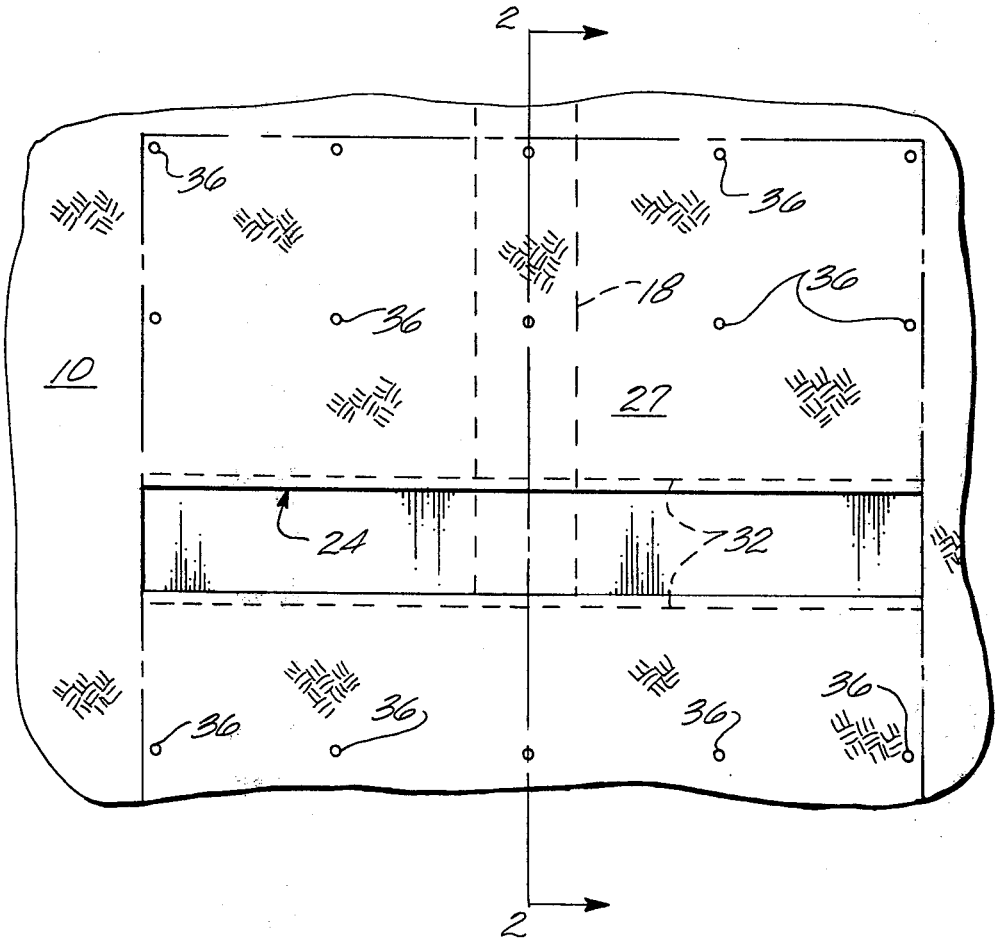
FIG. 3 is a semi-schematic cross-sectional plan view taken on line 3—3 of FIG. 2.

FIGS. 2 and 3 illustrate an in situ oil shale retort formed in accordance with principles of this invention. FIGS. 2 and 3 are semi-schematic vertical and horizontal cross-sections, respectively, at one stage during preparation of the in situ retort. As illustrated in these figures, the in situ oil shale retort is being formed in a subterranean formation 10 containing oil shale. The in situ retort shown in FIGS. 2 and 3 is rectangular in horizontal cross-section, and as shown in phantom lines in FIG. 2, the retort being formed has a top boundary 12, four vertically extending side boundaries 14, and a lower boundary 16. A drift 18 at a production level provides a means for access to the lower boundary of the in situ retort. Formation which is excavated to form the drift 18 is transported to above ground through an adit or shaft (not shown).

The in situ oil shale retort is formed by excavating a portion of the formation to form an open base of operation 20 on an upper working level. The floor of the base of operation 20 is spaced above the upper boundary 12 of the retort being formed, leaving a horizontal sill pillar 22 of unfragmented formation between the bottom of the base of operation 20 and the upper boundary 12 of the retort being formed. The horizontal extent of the base of operation 20 is sufficient to provide effective access to substantially the entire horizontal cross-section of the retort being formed. Such a base of operation 20 provides access for excavation operations for forming a void within the retort site, as well as for drilling and explosive loading for subsequently explosively expanding formation toward such void to form a fragmented permeable mass of formation particles in the retort being formed. The base of operation 20 also facilitates introduction of oxygen supplying gas into the top of the fragmented mass formed below the horizontal sill pillar 22.

According to the embodiment shown in FIG. 2, the in situ retort is prepared by excavating a portion of the formation within the retort site to form a vertically extending columnar void or slot 24. This leaves a remaining portion of unfragmented formation adjacent the void and within the boundaries of the retort site. Such unfragmented formation is to be explosively expanded toward the slot 24. Unfragmented formation defining the side walls of the slot provides parallel free faces toward which the remaining unfragmented formation within the boundaries of the retort site is explosively expanded to form a fragmented permeable mass of formation particles containing oil shale within the completed retort. The vertical slot 24 extends upwardly from the production level access drift 18 to the upper boundary 12 of the retort being formed. The length of the slot, when viewed in plan view as in FIG. 3, extends essentially the entire distance between the opposite side walls 14 of the retort being formed. The slot is located within the side boundaries of the retort so that the long dimension of the slot extends across the center of the horizontal cross-section of the retort being formed. FIG. 2 illustrates the width, or narrow dimension, of the slot being located essentially in the center of the boundaries 14 defining the sides of the retort being formed. In one embodiment the slot is over 120 feet in length and about 24 feet wide. The slot is over 200 feet in height and provides a void fraction of about 20% in the fragmented permeable mass of formation particles formed within the completed retort.

In a working embodiment, the slot 24 is formed by initially drilling and boring a four-feet diameter circular raise 26 extending between the base of operation 20 and the access drift 18. The raise 26 is bored at the center of the slot being formed. Rows of blasting holes (not shown) are drilled downwardly from the base of operation on opposite sides of the raise 26. The blasting holes extend from the base of operation 20 to the production level access drift 18. The blasting holes are loaded with explosive up to an elevation corresponding to the top boundary of the slot being formed. That is, a portion of the blasting holes extending through the sill pillar 22 are stemmed to inhibit breakage above the top boundary of the slot being formed. Such explosive is detonated in increments to explosively expand formation toward the free face provided by unfragmented formation surrounding the raise to enlarge the raise in steps progressing lengthwise along the slot being formed. Drilling and blasting sequences are repeated until the length of the slot is enlarged to the full width of the retort being formed. A more complete description of the techniques for forming the slot 24 are disclosed in U.S. Pat. Nos. 4,043,595 and 4,043,596. These patents are assigned to the same assignee as this application and are incorporated herein by this reference.

Ultimately the void space of the slot 24 becomes distributed in the void volume in the fragmented permeable mass of formation particles in the completed in situ retort. As used herein void volume and void fraction can be used interchangeably unless the context clearly indicates otherwise. The horizontal cross-sectional area of the slot 24 has the same ratio to the horizontal cross-section of the retort being formed as the desired void fraction in the fragmented mass. Thus, for example, if it is desired to have a void fraction of about 15% in a fragmented mass in the retort, the horizontal cross-sectional area of the slot 24 is 15% of the area within the side boundaries 14 of the retort being formed.

Figure 4:
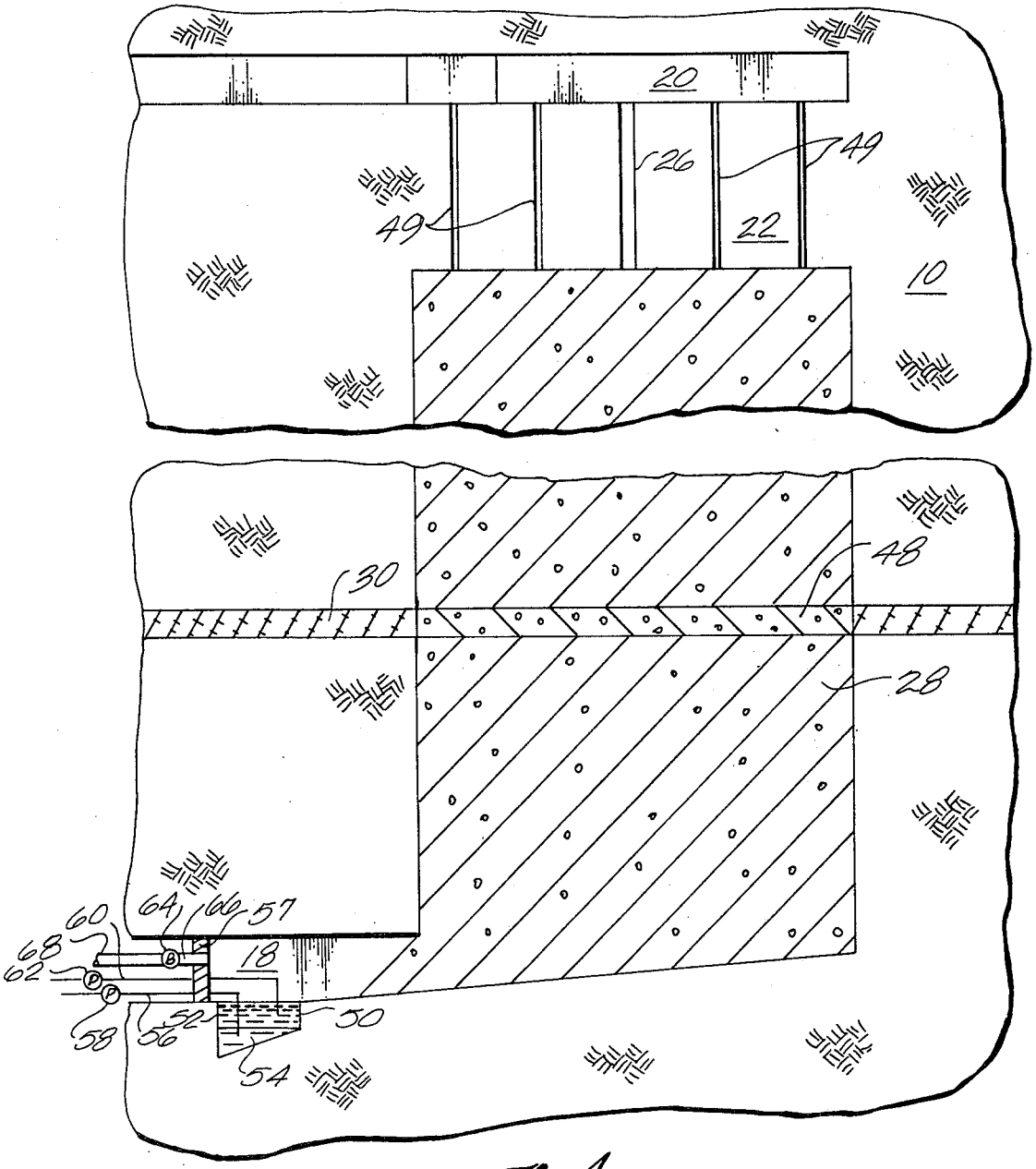
FIG. 4 is a semi-schematic cross-sectional side view showing the in situ retort of FIGS. 2 and 3 after explosive expansion of formation in the retort site.

After the slot 24 is excavated, unfragmented formation 27 remaining within the retort site is explosively expanded toward the slot to form a fragmented permeable mass of formation particles 28 containing oil shale in a completed in situ retort shown in FIG. 4. It is desirable to have good permeability in the fragmented mass in order to transmit gases through the fragmented mass without an undue pressure drop. Increased pressure drop leads to greater power consumption. A relatively small void volume, on the other hand, is desired to minimize the amount of formation excavated to form the void space within the retort site prior to explosive expansion. Excavating such formation can be expensive, and a relatively small void volume is desirable to maximize the yield of shale oil from the fragmented mass.

FIGS. 2 and 4 illustrate a stratum 30 of formation having an average kerogen content which is higher than the average kerogen content of formation within the boundaries of the in situ retort being formed. Thus, for example, the average kerogen content of the formation in the entire volume to become the in situ retort can be about 17 to 18 gallons per ton. The stratum 30 of relatively richer kerogen content can have a Fischer assay of over 30 gallons per ton. For purposes set out in greater detail below, the transverse cross-section of the slot 24 is enlarged in the stratum 30 of formation having the relatively higher kerogen content. The stratum 30 of higher kerogen content can be several feet thick and in the embodiment shown the stratum 30 extends in a generally horizontal plane through the formation 10, including through the retort site. The portion of the slot 24 which extends through the stratum 30 is enlarged along the length of the slot from one side boundary 14 of the retort being formed to the opposite side boundary 14. Thus, the horizontal cross-sectional area of the enlargement 32 is greater than the horizontal cross-sectional area of the remaining portion of the slot 24. The enlargement 32 is preferably formed by excavating substantially equal amounts of formation from opposite side walls of the slot 24. The vertical dimension of the enlargement 32 coincides with the thickness of the stratum 30. The depth of the enlargement into the stratum 30 is directly proportional to the average kerogen content of the stratum. Thus, a stratum of 50 gallons per ton kerogen content is enlarged more than a stratum having a kerogen content of 30 gallons per ton. Although one such stratum of higher kerogen content is illustrated in the figures, more than one stratum can extend through the retort site, in which case the slot 24 would be enlarged along the length of each such stratum.

Thus, the specific volume of the enlarged portion 32 of the slot is greater than the specific volume of the remaining portion of the slot. Specific volume refers to the volume of a given void space relative to the total volume of the same void space plus the formation to be explosively expanded toward the void space.

In a working embodiment, the horizontal cross-sectional area of the slot 24 can be in the order of about 15% to about 25% of the desired horizontal cross-sectional area of the fragmented mass in the retort being formed; and in this instance the horizontal cross-sectional area of the enlargement 32 would be correspondingly greater, which can be about 20% to about 30%, respectively, of the desired cross-sectional area of the same fragmented mass.

The enlargement of the slot can be formed by drilling vertical blasting holes 34 (such blasting holes are shown in FIG. 2 but are omitted in FIG. 3 for clarity) downwardly from the base of operation 20 through unfragmented formation adjacent the opposite side walls of the slot 24. The blasting holes 34 are drilled in separate rows extending parallel to the vertical side walls of the slot, and they are spaced apart from the walls of the slot by a distance corresponding to the depth of the enlargement being formed. Only the portions of the blasting holes 34 which extend through the stratum 30 of higher kerogen content are loaded with explosive and detonated. The remaining portions of the blasting holes 34 are stemmed. Explosive in the blasting holes 34 can be detonated at the same time that the slot 24 is enlarged so that a slot having the enlargement 32 in the stratum 30 of higher kerogen content is formed when detonating such explosive in a single round. Alternately, the enlargement 32 can be formed in a separate blasting step after the slot 24 is initially excavated. In this instance the enlargement can be formed by detonating explosive in the blasting holes 34 after the slot 24 is formed; or by drilling blasting holes (not shown) which extend generally horizontally outwardly from the slot to the desired depth in the stratum 30 of higher kerogen content. These latter blasting holes are loaded with explosive and detonated to remove an additional amount of formation from the stratum 30 of higher kerogen content after the blasting steps for forming the slot 24 are completed. Thus, the invention can be carried out by enlarging a slot or void in a retort site either in a single blasting step or in a succession of blasting steps.

Following formation of the slot 24 and the enlargment 32 in the stratum 30 of higher kerogen content, blasting holes 36 (illustrated in phantom lines in FIG. 2) are drilled downwardly from the base of operation 20, through unfragmented formation 27 remaining within the retort site, to the lower boundary 16 of the retort being formed. The outer rows of blasting holes substantially coincide with the side boundaries 14 of the retort being formed. Explosive is loaded into such blasting holes 36 and detonated to explosively expand formation toward the free faces provided by the walls of unfragmented formation adjoining the slot 24. This forms the fragmented permeable mass of formation particles 28 containing oil shale within the retort site as illustrated in FIG. 4. Drilling and blasting techniques used in forming the fragmented mass 28 are described in greater detail in application Ser. No. 790,350, entitled IN SITU OIL SHALE RETORT WITH A HORIZONTAL SILL PILLAR, filed Apr. 25, 1977, by Ned M. Hutchins, now U.S. Pat. No. 4,118,071. That application is assigned to the same assignee of the present invention and is incorporated herein by this reference. Techniques for forming the fragmented mass 28 also are described in the above-mentioned U.S. Pat. Nos. 4,043,595 and 4,043,596.

The explosive expansion step distributes the void volume of the slot 24 into the interstices between particles in the mass of fragmented formation particles remaining after explosive expansion. Formation is explosively expanded into the adjacent void primarily due to the influence of the explosives, and the entire blasting sequence occurs in such a short time interval that gravity has a relatively minor influence. Thus, along most of the length of the slot the movement of the fragmented formation particles is almost exclusively inward. A portion of unfragmented formation within the retort site is explosively expanded into the portion of the production level drift 17 extending under the retort site. Because of the relatively minor cross-sectional area of the production level drift compared to the volume of formation within the retort site being explosively expanded, the amount of formation explosively expanded into the drift 18 is considered to be negligible in determining the void fraction in the fragmented mass. Thus, the void fraction of the fragmented mass is determined by the proportion of the cross-sectional area of the slot 24 to the cross-sectional area within the side boundaries 14 of the in situ retort being formed. A somewhat higher than average void fraction may be present in the vicinity of the production level drift 18 if formation is allowed to expand into it. However, the production level drift 18 can be backfilled with fragmented formation particles after the slot 24 is excavated and before explosive expansion to minimize the effect of the drift on the void fraction at the bottom of fragmented mass 28.

Following explosive expansion the in situ retort has the appearance illustrated in FIG. 4 in which the fragmented mass 28 has a zone or layer 48 of fragmented formation particles from the formation stratum 30 having the higher kerogen content. The formation particles in the zone or layer 48 are explosively expanded more than the average expansion of fragmented formation particles throughout the fragmented mass. In other words, the zone 48 has a larger void fraction than the average void fraction throughout the fragmented mass 28. Thus, the explosive expansion step produces a fragmented permeable mass of formation particles containing oil shale in an in situ retort, in which a first portion of such fragmented mass has a relatively lower average kerogen content and a relatively lower average void fraction, and in which a second portion of such fragmented mass in another region of the retort from the first portion has a relatively higher kerogen content and a relatively higher void fraction. For example, the fragmented mass 28 can have a certain average kerogen content (for example, about 17 gallons per ton) and an average void fraction (for example, less than about 25%). The fragmented mass also can have the zone 48 that has a relatively higher kerogen content (for example, over 30 gallons per ton) and also a relatively higher void fraction (for example, more than about 25%). In this portion of the fragmented mass both the kerogen content of the fragmented formation particles and the void fraction are higher than the average for the entire fragmented mass.

Figure 5:
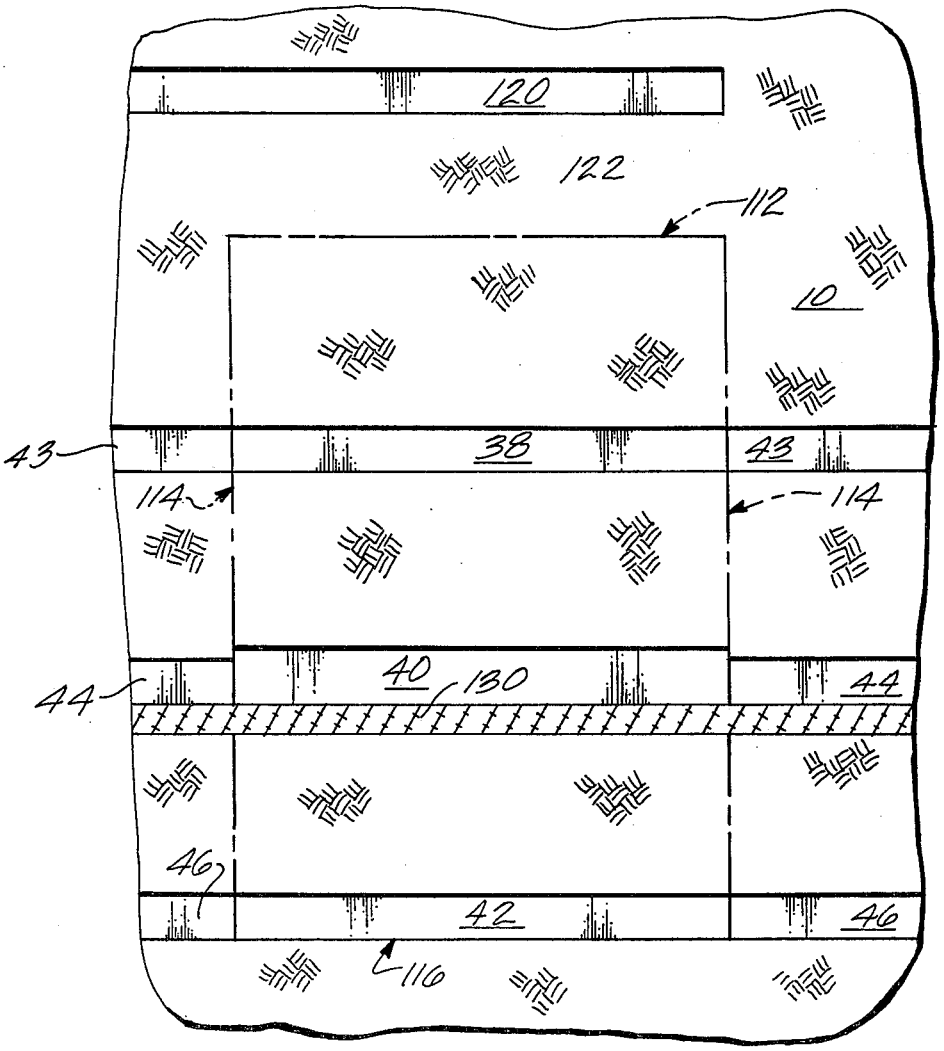
FIG. 5 is a semi-schematic cross-sectional side view showing an alternate method of forming a retort in which horizontal voids are excavated in the retort site and in which one of the voids is enlarged in proximity to a stratum of formation having a higher average kerogen content than the average kerogen content of formation within the retort site.

FIG. 5 shows an alternate method of forming a void volume within a retort site in preparation for forming an in situ retort. In the method shown in FIG. 5, three vertically spaced apart horizontal voids are formed within the boundaries of the retort site. A rectangular upper horizontal void 38 is excavated at an upper retort access level, a rectangular intermediate horizontal void 40 is excavated at an intermediate retort access level, and a rectangular lower horizontal void 42 is excavated at a lower retort access level. The horizontal cross-section of each horizontal void is substantially similar to that of the retort being formed. In the embodiment shown, a retort level access drift extends through opposite side boundaries of the retort site at each level, and each of such access drifts is centered in its respective horizontal void. Thus, an upper level retort access drift 43 extends through opposite side walls of the upper level void 38; an intermediate level retort access drift 44 opens through opposite side walls of the intermediate level void 40; and a lower level retort access drift 46 opens through opposite side walls of the lower level void 42. Each horizontal void 38, 40, 42 has a horizontal free face having an area substantially larger than the transverse cross-section of the access drift extending into the void. Further details of techniques for forming retorts using such horizontal void volumes are more fully described in U.S. Pat. Nos. 4,043,597, and 4,043,598. These patents are assigned to the same assignee as this application and are incorporated herein by this reference.

FIG. 5 illustrates a formation stratum 130 having a higher kerogen content than the average kerogen content of formation within the retort site. In the embodiment depicted in FIG. 5 the stratum 130 extends generally horizontally through the formation and through the retort site. For the purposes of this invention, the vertical dimension or height of a void in proximity to the stratum 130 or higher kerogen content is enlarged relative to the vertical dimension of those voids extending through formation of relatively lower kerogen content. Thus, in the embodiment shown in FIG. 5, wherein the stratum 130 of relatively higher kerogen content is in the vicinity of the intermediate level void 40, the intermediate void 40 is excavated to provide a greater vertical dimension or void volume adjacent the stratum 130 than the corresponding vertical dimensions of the upper and lower voids 38 and 42, respectively. After completing the upper, intermediate and lower level voids, formation is explosively expanded toward such voids to form a fragmented permeable mass of formation particles (not shown) containing oil shale within the upper, side and lower boundaries 112, 114, and 116, respectively, of the retort. Vertical blasting holes (not shown) are drilled in the zones of unfragmented formation between the upper, intermediate and lower voids. Explosive is loaded into such blasting holes and detonated in a single round for explosively expanding the unfragmented zones toward the horizontal free faces of formation adjacent the voids. In the resulting fragmented mass the void fraction of formation expanded toward the intermediate level void 40 is greater than the void fraction of formation expanded toward the upper and lower voids 38 and 42.

As a further alternative, the void volume in the retort being formed can be provided by a columnar void in the form of a cylindrical raise (not shown). In this instance, the portion of the raise which passes through a stratum of higher kerogen content can be enlarged around its entire inside surface of the raise. Techniques for forming a fragmented mass from a cylindrical raise are described in detail in U.S. Pat. No. 4,043,595 referred to above.

During retorting operations the fragmented formation particles at the top of the fragmented mass 28 are ignited to establish a combustion zone at the top of the fragmented mass. Air or other oxygen supplying gas is supplied to the combustion zone from the base of operation through passages or conduits 49 extending downwardly from the base of operation through the sill pillar 22 to the top of the fragmented mass 28. Air or other oxygen supplying gas introduced to the fragmented mass maintains the combustion zone and advances it downwardly through the fragmented mass. Hot gas from the combustion zone flows through the fragmented mass on the advancing side of the combustion zone to form a retorting zone where kerogen in the fragmented mass is converted to liquid and gaseous products. As the retorting zone moves down through the fragmented mass, liquid and gaseous products are released from the fragmented formation particles. A sump 50 in the portion of the production level access drift 18 beyond the fragmented mass collects liquid products, namely, shale oil 52 and water 54, produced during operation of the retort. A water withdrawal line 56 extends from near the bottom of the sump out through a sealed opening (not shown) in a bulk-head 57 sealed across the access drift 18. The water withdrawal line is connected to a water pump 58. An oil withdrawal line 60 extends from an intermediate level in the sump out through a sealed opening (not shown) in the bulkhead and is connected to an oil pump 62. The oil and water pumps can be operated manually or by automatic controls (not shown) to remove shale oil and water separately from the sump. The inlet of a blower 64 is connected by a conduit 66 to an opening through the bulkhead 57 for withdrawing off gas from the retort through a conduit 68 to a recovery or disposal system (not shown).

As described above, the heat of combustion establishes a retorting zone below the combustion zone in which the fragmented formation particles are heated so that kerogen decomposes and shale oil and hydrocarbon gases are released. Temperatures in the retorting zone range up to about 900 degrees F. Temperatures in the combustion zone can be in the order of 1200 to 1500 degrees F. As the retorting zone and combustion zone travel slowly down through the fragmented mass, a zone of hot combusted formation particles accumulates above the combustion zone. This zone of combusted formation particles can gradually increase in thickness as retorting continues, inasmuch as the rate of heat generation due to combustion is greater than the cooling effect of processing gas being added through the top of the fragmented mass. Thus, for example, after a period of retorting, a zone of hot combusted formation particles above the combustion zone at temperatures of 1000 to 1300 degrees F. can be from 20 to 40 feet thick.

Thermal expansion of fragmented formation particles in the retorting zone and the high temperature combustion zone is of significance in affecting the pressure drop across the fragmented mass. Thermal expansion in the zone of hot spent formation particles also has an influence on pressure drop. There is also some influence on pressure drop due to thermal degradation of the fragmented formation particles. Removal of kerogen and some decomposition of inorganic carbonates results in a weakening of particles. Some breakage of particles therefore occurs and the increased surface-to-volume ratio of the particles also contributes to gas flow resistance. Thus, during retorting operations the total length of hot fragmented formation particles through which the retorting gas passes is increased, and there is a gradual increase in the pressure required for a given flow rate through the fragmented mass.

As described above, the expansion of fragmented formation particles is dependent upon the kerogen content, with high kerogen content formation particles having a relatively high degree of thermal expansion. As the high temperature zone reaches a stratum of relatively high kerogen content formation, such as the zone 48 of high kerogen content in the fragmented mass, there is a significantly greater expansion than there is in the relatively lower grade fragmented formation particles in the balance of the fragmented mass. In the absence of an increased void fraction in the portion 48 having the higher kerogen content, there can be a very substantial increase in resistance to flow of gas through the fragmented mass.

Figure 6:
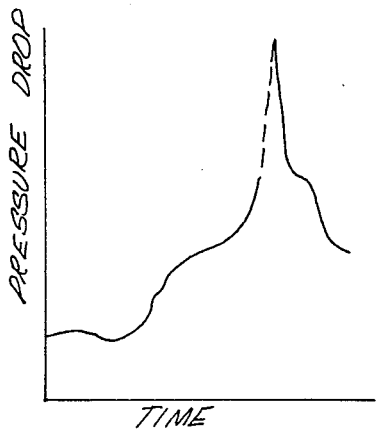
FIG. 6 is a graph showing pressure drop during retorting operations in an in situ retort formed without practicing this invention.

Thus, for example, FIG. 6 is a graph illustrating a variation of pressure drop as a function of time during retorting in an in situ oil shale retort in which the present invention is not practiced. For example, in FIG. 6 it is assumed that the fragmented mass has an average void fraction in the order of about 15% and there is no increased void fraction in any portion occupied by high grade formation particles containing oil shale. This retort differs from the exemplary one of FIG. 5 only in this respect. Time on the abscissa of FIG. 6 is measured in days and the graph represents an elapsed time of about four months. The pressure drop is normalized to be in units of pressure drop per unit length and is representative of the total pressure drop across the the full length of the retort, but is independent of length so that different retorts can be compared. It is also compensated for variations in retorting gas flow rate. Thus, it represents a measure of the true resistance to gas flow through the fragmented mass.

In the example illustrated in FIG. 6, after about three months of operation, a formation stratum of relatively rich formation particles containing oil shale having a kerogen content in excess of about 30 gallons per ton was encountered by the retorting zone. Up to that time the total pressure drop across the fragmented mass had gradually increased due to normal thermal expansion. When the stratum of relatively rich kerogen content was encountered, its significantly higher expansion caused an increase in the flow resistance represented by the rather sharp peak in the pressure curve of FIG. 6. After the highest temperature portion of the retorting zone and combustion zone passed the stratum of relatively rich kerogen content, the pressure required for a given flow rate along the length of the fragmented mass dropped back to near the same value before the zone of relatively rich kerogen content was encountered.

As described above, the increased resistance to gas flow due to expansion of the fragmented formation particles containing oil shale is a significant factor when the average void volume of the fragmented mass is relatively low, say below about 20%. Retorts formed by backfilling an existing cavity with mined out fragmented formation particles can have a void fraction in the order of about 30%. Expansion of fragmented formation particles in such a retort poses no particular problem, but the cost of forming such a fragmented mass can be prohibitive.

Preferably, the void volume in an in situ retort is in the order of about 15% to 25% for minimizing mining costs while maximizing yield without excessive pressure requirements. The term "in the order of about 15% to 25%" is used herein to indicate a void fraction that is large enough to be explosively expanded and small enough that resistance to gas flow can be a problem due to expansion of fragmented formation particles of rich kerogen content. If the void fraction is less than about 10% fragmentation problems can be encountered and flow resistance can be substantial for even nominal expansion of the formation particles upon heating. When the average void volume is in the order of about 30%, problems due to thermal expansion during retort are not of great significance in most formations containing oil shale where the extent of high grade shale is not extensive. Thus, in a fragmented mass having a void volume in the range of about 15% to about 25%, that is, in the order of about 20%, expansion of formation particles containing oil shale upon retorting can be a significant factor in pressure drop across the fragmented mass. It is therefore important that an increased void fraction be provided in a stratum of formation particles containing oil shale of high kerogen content, as compared with the relatively leaner fragmented formation particles containing oil shale from other portions of the formation. It is found that a void fraction in the order of about 15% to 25% is satisfactory for retorting formation containing oil shale having a kerogen content up to about 30 gallons per ton. No problems have been encountered due to expansion in formation particles containing oil shale having a kerogen content less than about 20 gallons per ton.

When the kerogen content of the formation particles exceeds about 30 gallons per ton, it is preferred to have a void fraction in that portion of the retort of at least about 20%. Thus, as in the illustrated embodiment, the average void fraction in the fragmented mass remote from the zone 48 of formation particles from the stratum of higher kerogen can be in the order of about 15% to 25%; and a void fraction of about 20% to 30% is provided in that portion of the fragmented mass having formation particles with a kerogen content in excess of about 30 gallons per ton. Further, if the extent of very high grade formation containing oil shale having in excess of about 50 gallons per ton kerogen content has an appreciable thickness, it is preferred to have a void fraction of about 25% to 30% to minimize increases in gas flow resistance. Since such high grade strata are not common, principal applicability of this technique is where the average void volume is less than about 25% and strata of formation containing oil shale with a kerogen content of more than about 30 gallons per ton are present in the formation.

Any formation of relatively rich kerogen content excavated in forming an enlargement, such as that in the stratum 30 shown in FIG. 2, can be separately retorted so that its kerogen content is not wasted. If desired, this material can be left at the bottom of the slot 24 prior to explosive expansion, since enlargement of the slot is ordinarily the last operation before explosive expansion of the remaining unfragmented formation within the retort site. This permits the higher grade formation to be retorted in situ in the same retort volume in which it was displaced for opening the void space for the increased void fraction.

Figure 7:
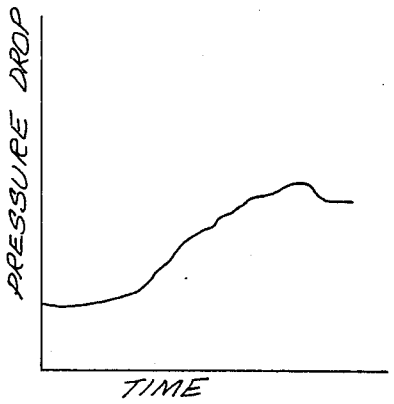
FIG. 7 is a similar graph showing pressure drop during retorting operations in an in situ retort formed according to principles of this invention.

FIG. 7 is a schematic graph showing pressure drop as a function of time as a fragmented mass formed according to the practice of this invention is retorted. Throughout most of the length of the fragmented mass, formation explosively expanded into the portion of the slot 24 remote from the enlargement 32 has a specific volume that yields a void fraction in the order of about 20%. Formation containing oil shale in the relatively rich stratum 30 expands into the enlarged open space provided by the enlargement 32 which has a larger specific volume and yields a void fraction of about 25%. The total volume of the slot can be larger than the total volume of the enlargement into which the rich stratum explosively expands, but the specific volume is less. As described above, specific volume is the proportion of the volume of the void space into which a portion of formation expands relative to the total volume of that void space plus the formation to be expanded into it. Throughout most of the length of the slot 24 the specific volume is proportional to the horizontal cross-sectional area of the slot relative to the total horizontal cross-sectional area of the fragmented mass being formed.

Upon explosive expansion in a manner described above, most of the fragmented mass has a void fraction of about 20%. That portion of the fragmented mass having fragmented formation particles containing oil shale with a kerogen content of over 30 gallons per ton has a void fraction of over about 25%.

The top of the fragmented mass is ignited as described above and air diluted with off gas from retorting operations, so as to have an oxygen content 14%, is introduced into the top of the fragmented mass to sustain the combustion zone and cause it to move downwardly through the fragmented mass as off gas is withdrawn from the bottom of the fragmented mass. This combustion zone and consequent retorting zone progress down through the fragmented mass at a rate of about one foot per day. Shale oil and hydrocarbon gases from decomposition of kerogen in the fragmented formation particles travel to the bottom of the fragmented mass where they are recovered. In the graph shown in FIG. 7, the total elapsed time can, for example, be eight months or more. As in FIG. 6, the pressure is normalized for length and flow rate. No anomalous high pressure drops due to expansion of fragmented formation particles of high kerogen content occur, as shown in the curve of FIG. 7. By having a relatively larger void fraction in relatively higher kerogen content formation particles in an in situ retort, high pressure drop conditions across the fragmented mass can be minimized.

Although embodiments of this invention have been described and illustrated herein, many modifications and variations will be apparent to one skilled in the art. The invention has been described in the context of a formation containing oil shale having essentially horizontal strata. The same principles are applied to in situ oil shale retorts having different orientations accommodating the dip of the formation containing oil shale. They also are suitable where the strata are not normal to the length of the retort being formed, but are merely transverse at some other angle. It also will be apparent that the described techniques for fragmenting the formation to form the fragmented mass and for producing an increased void fraction in the relatively higher kerogen content formation stratum are only exemplary and a variety of such techniques can be employed. Thus, for example, the open space in the vicinity of the relatively rich kerogen content strata can be provided by means other than the enlarged slot, or horizontal void volumes described above. Thus, for example, an open space can be formed immediately above or below a stratum of high kerogen content so that upon explosive expansion the relatively high kerogen content formation expands into this open space to have a higher void fraction than the balance of the fragmented mass being formed. Many other mofications and variations will be apparent to one skilled in the art; and it is therefore to be understood that within the scope of the appended claims the invention may be practiced otherwise than as specifically described.

What is claimed is:

1. A method for recovering liquid and gaseous products from an in situ oil shale retort in a subterranean formation containing oil shale and having a plurality of strata of formation extending through a retort site, at least one stratum of formation having a higher kerogen content than the average kerogen content of formation within the retort site, the method comprising the steps of:

excavating at least one void within the retort site and leaving a remaining portion of unfragmented formation within the retort site, the void being enlarged in proximity to such a stratum of higher kerogen content;

placing explosive in the remaining portion of unfragmented formation within the retort site;

detonating such explosive to explosively expand such portion of unfragmented formation toward such a void, including explosively expanding such a stratum of higher kerogen content toward such enlarged portion of such a void, for forming a fragmented permeable mass of formation particles containing oil shale in an in situ oil shale retort, in which a mass of fragmented formation particles from such a stratum of higher kerogen content has a higher void fraction than the average void fraction of the fragmented mass of formation particles in the balance of the fragmented mass;

establishing a combustion zone in the fragmented mass;

introducing an oxygen supplying gas to the fragmented mass for sustaining the Combustion zone in the fragmented mass and for advancing the combustion zone through the fragmented mass whereby kerogen is decomposed in a retorting zone in the fragmented mass on the advancing side of the combustion zone for producing liquid and gaseous products; and withdrawing such liquid and gaseous products from the fragmented mass on the advancing side of the combustion zone.

2. The method according to claim 1 in which the excavating step comprises excavating a void extending transversely to such a stratum of higher kerogen content and enlarging the void only in the vicinity of such stratum; and in which the detonating step comprises explosively expanding formation within the retort site toward such a void, including expanding such stratum toward the enlarged portion of the void.

3. The method according to claim 1 in which such a stratum of higher kerogen content extends generally horizontally through the retort site; and in which the excavating step comprises excavating a void which extends vertically through the stratum of higher kerogen content, and excavating formation so that the horizontal cross section of the void in proximity to the stratum of higher kerogen content is greater than the average horizontal cross section of the vertical void, and thereafter explosively expanding formation toward such void, including the enlarged portion of the void.

4. In a method for forming an in situ oil shale retort in a subterranean formation containing oil shale, wherein formation within a retort site in such formation is explosively expanded to form an in situ oil shale retort containing a fragmented permeable mass of formation particles containing oil shale, such formation including a generally horizontally extending stratum of formation having a higher kerogen content than the average kerogen content of formation in the retort site, the improvement comprising the steps of excavating a void which extends vertically through the stratum of higher kerogen content, excavating formation so that the horizontal cross section of the void in proximity to the stratum of higher kerogen content is greater than the average horizontal cross section of the vertical void, and thereafter explosively expanding formation toward such void so that fragmented mass containing particles from the stratum of higher kerogen content has a higher void fraction than the average void fraction of the fragmented mass.

5. In a method for forming an in situ oil shale retort in a retort site in a subterranean formation containing oil shale and having a stratum of formation extending through the retort site having a higher kerogen content than the average kerogen content of formation within the retort site, comprising the steps of explosively expanding formation within the retort site which is outside such stratum to have a first void fraction, and explosively expanding formation in the retort site which is within such stratum to have a second void fraction which is higher than the first void fraction, the improvement comprising the steps of excavating a first void in a first region of formation within the retort site remote from such stratum, the first void having a volume relative to the volume of the first region of formation corresponding to the first void fraction; excavating a second void in a second region of formation within the retort site in the vicinity of such stratum, the second void having a volume relative to the volume of the second region of formation corresponding to the second void fraction; and explosively expanding formation toward the first and second voids to form a fragmented permeable mass of formation particles in the retort, the portion of the fragmented mass expanded toward the first void having the first void fraction and the portion of the fragmented mass expanded toward the second void having the second void fraction.

6. In a method for forming an in situ oil shale retort in a retort site in a subterranean formation containing oil shale and having at least one startum of formation having a higher kerogen content than the average kerogen content within the retort site, the improvement comprising explosively expanding formation from such a stratum of higher kerogen content toward a void having a relatively higher specific volume, explosively expanding the balance of formation within the retort site toward a void having a relatively lower specific volume to form a fragmented permeable mass of formation particles containing oil shale in an in situ retort in which a mass of fragmented formation particles from such a stratum of higher kerogen content has a higher void fraction than the average void fraction of the mass of fragmented formation particles in the balance of the fragmented mass.

7. A method for forming an in situ oil shale retort in a retort site in a subterranean formation containing oil shale and having at least one stratum of formation with a kerogen content higher than the average kerogen content of formation within the retort site, comprising the steps of:

excavating a void in the retort site and leaving a remaining portion of unfragmented formation within the retort site adjacent the void;

enlarging a portion of the void in formation in proximity to such a stratum of higher kerogen content; and explosively expanding the portion of unfragmented formation remaining in the retort site toward the void, including expanding formation in such a stratum towards the enlarged portion of the void, to form a fragmented permeable mass of formation particles containing oil shale in an in situ retort in which a portion of fragmented formation particles in proximity to such stratum of higher kerogen content is expanded more than the average expansion of formation particles forming the fragmented mass.

8. The method according to claim 7 in which such a stratum extends generally horizontally through the retort site, and the void extends vertically through the retort site; and including the step of enlarging the horizontal cross section of the void only within such a stratum of higher kerogen content.

9. A method for forming an in situ oil shale retort in a subterranean formation containing oil shale and having a plurality of strata extending generally horizontally through the site of the in situ oil shale retort being formed, at least one of the strata having a higher kerogen content than the average kerogen content of formation within the retort site, the method comprising the steps of:

excavating a generally vertically extending void within the retort site, leaving a remaining portion of unfragmented formation within boundaries of the retort being formed;

enlarging a portion of the void in the vicinity of such stratum of formation having a higher than average kerogen content so that the transverse cross section of enlarged portion is greater than the average transverse cross section of the remaining portion of the void; and explosively expanding such remaining portion of unfragmented formation toward such void, including the enlarged portion of the void, for forming a fragmented permeable mass of formation particles containing oil shale in an in situ retort.

10. The method according to claim 9 including forming the void with a first horizontal cross-sectional area remote from such stratum, and forming the enlarged portion of the void with a second horizontal cross-sectional area in such stratum of formation having a higher than average kerogen content, the second horizontal cross-sectional area being larger than the first horizontal cross-sectional area.

11. The method according to claim 10 in which the ratio of the first horizontal cross-sectional area to the horizontal cross-sectional area of the in situ retort being formed is less than about 20%; and the ratio of the second horizontal cross-sectional area to the horizontal cross-sectional area of the retort being formed is greater than about 20%.

12. The method according to claim 11 in which the ratio of the first horizontal cross-sectional area to the horizontal cross-sectional area of the retort being formed is in the order of about 20%; and in which such stratum of formation having higher than average kerogen content has a kerogen content greater than about 30 gallons per ton.

13. The method according to claim 9 in which the higher than average kerogen content is more than about 30 gallons per ton, and in which the average horizontal cross-sectional area of the void remote from such stratum is in the order of about 20% of the horizontal cross-sectional area of the retort being formed; and in which the horizontal cross-sectional area of the void is enlarged in the vicinity of such stratum of formation having higher than average kerogen content to more than about 25% of the horizontal cross-sectional area of the in situ retort being formed.

* * * * *

UNITED STATES PATENT AND TRADEMARK OFFICE

CERTIFICATE OF CORRECTION

PATENT NO. : 4,167,291

DATED : September 11, 1979

INVENTOR(S) : Richard D. Ridley

It is certified that error appears in the above-identified patent and that said Letters Patent are hereby corrected as shown below:

Column 2, line 31, "formtion" should be -- formation;
line 40, "is" should be deleted.
Column 4, line 61, delete "by the", (second occurrence).
Column 5, line 14, "$\varepsilon=\varepsilon_0-\gamma(1-\gamma)$" should be -- $\varepsilon=\varepsilon_0-\gamma(1-\varepsilon_0)$ --.
Column 6, line 30, the comma should be a period.
Column 13, line 23, delete "the", (second occurrence).
Column 15, line 63, "mofications" should be -- modifications --.
Column 16, line 31, "Combustion" should be -- combustion --.
Column 17, line 39, "startum" should be -- stratum --.

Signed and Sealed this

*Eleventh* Day of *December 1979*

[SEAL]

*Attest:*

SIDNEY A. DIAMOND

*Attesting Officer*

*Commissioner of Patents and Trademarks*